US005328315A

United States Patent [19]

Sakamoto et al.

[11] Patent Number: 5,328,315

[45] Date of Patent: Jul. 12, 1994

[54] MULTISTORY MULTICOLUMN STORING INSTALLATION

[75] Inventors: Masatoshi Sakamoto, Ebina; Mitunori Oshita, Kure, both of Japan

[73] Assignee: Ebisu Engineering Kabushiki Kaisha, Kanagawa, Japan

[21] Appl. No.: 929,896

[22] Filed: Aug. 11, 1992

[30] Foreign Application Priority Data

Dec. 3, 1991 [JP] Japan ..... 3-319293

[51] Int. Cl.[5] ..... E04H 6/12

[52] U.S. Cl. ..... 414/236; 414/239

[58] Field of Search ..... 414/233-238, 414/264, 267, 256, 239, 240

[56] References Cited

U.S. PATENT DOCUMENTS

| | | | |
|---|---|---|---|
| 1,828,308 | 10/1931 | Been | 414/239 |
| 1,931,402 | 10/1933 | Black | 414/239 |
| 2,864,515 | 12/1958 | Marshall | 414/234 |
| 3,125,235 | 3/1964 | Frangos | 414/239 |
| 3,333,714 | 8/1967 | Sermet | 414/239 |
| 4,307,985 | 12/1981 | Desprez et al. | 414/234 X |
| 4,986,714 | 1/1991 | Fernstrom | 414/264 X |
| 5,018,926 | 5/1991 | Sternad | 414/234 X |
| 5,066,187 | 11/1991 | Hammer | 414/237 |

FOREIGN PATENT DOCUMENTS

| | | | |
|---|---|---|---|
| 413328 | 12/1966 | Switzerland | 414/239 |
| 2183619 | 6/1987 | United Kingdom | 414/238 |

*Primary Examiner*—David A. Bucci

*Attorney, Agent, or Firm*—Christensen, O'Connor, Johnson & Kindness

[57] ABSTRACT

This invention is related to a multistory, multicolumn storing installation capable of efficiently storing cargoes. The assembly includes a frame structure that defines four adjacent multistory columns A, B, C and D. Movable pallets P, each of which can be loaded with a cargo such as a vehicle, are normally stored in different layers in three of the columns. The pallets are seated on movable platforms T that shift the platforms laterally between adjacent columns. Lifting mechanisms 5 and 15, each of which is attached to a separate center-located column, B and C, move the pallets and their cargoes between the base level of the structure and the intermediate storage levels. A cargo is transferred between the base level and columns B and D by lifting the pallet through column C to the selected storage level and then laterally transferring it into column, B or D. A cargo is moved between a structure base level and storage column A by initially moving all of the pallets in column B into column C, and then moving the pallet to the selected level and laterally into position in column A.

17 Claims, 6 Drawing Sheets

MULTISTORY MULTICOLUMN STORING INSTALLATION

FIELD OF THE INVENTION

The present invention relates to a mechanical, multistory storing structure capable of individually storing many cargoes including vehicles in a limited space and, more specifically, relates to a multistory multicolumn storing installation capable of storing a plurality of pallets loaded with cargoes on storing platforms disposed respectively in multistory storing divisions.

BACKGROUND OF THE INVENTION

Conventional multistory storing installations are classified generally into those of a tower type having two columns provided with a plurality of multistory storing shelves, and disposed respectively on the opposite sides of a lift, and those of a traveling lift type having two storing blocks each consisting of multistory storing divisions arranged in a multistory, multicolumn arrangement, and a traveling crane or traveling forklift truck that travels in a space between the two storing blocks.

The multistory storing installation of a tower type is subject to limitations on its capacity and it is difficult to increase the storing shelves. The multistory storing installation of a traveling lift type needs a space for the traveling crane or the forklift truck in addition to the space for installing the multistory storing structure. These conventional multistory storing installations are unable to operate efficiently for storing cargoes and sending out cargoes. It is an object of the present invention to provide a multistory multicolumn storing installation capable of efficiently operating for storing and sending out large cargoes, such as vehicles and containers, and of readily accepting an increase in the number of columns.

SUMMARY OF THE INVENTION

To achieve the object, the present invention provides a multistory multicolumn storing installation comprising: a first block comprising two unpartitioned, parallel, storing columns, a lifting mechanism installed in one of the two storing columns, laterally movable platforms provided in the two storing columns in a vertical, multilayer arrangement so as to form storing divisions of the same height, each division being provided with a transporting unit and a driving unit for laterally moving each laterally movable platform provided in each storing division of each column; a second block of a construction similar to that of the first block, except that one of the columns is not provided with the laterally movable platforms, and disposed adjacent to the first block; and wherein each laterally movable platform carries thereon a pallet adapted to be separated from the platform to be transported vertically by the lifting mechanism.

In the multistory multicolumn storing installation of the present invention, each movable platform serves as the floor of each storing division, and a pallet loaded with a cargo can be supported on each movable platform. Each storing division of the storing column having the lifting mechanism respectively is provided with a transporting unit and a driving unit for laterally moving the movable platform. Since one od the columns of the second block equipped with the lifting mechanism does not have any movable platforms, it only defines an empty space. Consequently, the movable platforms in the storing divisions of the adjacent columns can be transferred into the empty space of the second block equipped with the lifting mechanism. Thus, when all the movable platforms in the storing divisions of the column of the first block adjacent to the column of the second block having the lifting mechanism have been transferred to the empty space of the column of the second block equipped with the lifting mechanism, the construction of the first block changes into the original construction of the second block, and the construction of the second block changes into the original construction of the first block.

Accordingly, the movable platform is evacuated temporarily to the empty space of the storing column of the second block having the lifting mechanism to make way for the movable platform loaded with a cargo to be unloaded, and then cargoes stored in the storing divisions can be sequentially transferred to the adjacent storing divisions. Thus, the movable platform loaded with a cargo to be unloaded or transported can be transferred into the empty space of the column having the lifting mechanism, and the pallet loaded with the cargo is separated from the movable platform and it can be moved vertically by the lifting mechanism.

BRIEF DESCRIPTION OF THE DRAWINGS

A multistory multicolumn storing installation in a preferred embodiment of the present invention as applied to a multistory parking garage will be described hereinafter with reference to the accompanying drawings in which:

FIGS. 4A–4D are diagrammatically explaining the operation of the multistory multicolumn storing installation of the present invention, in which FIGS. 4A and 4B illustrate the operation by using a lifting mechanism of a second block, and FIGS. 4C and 4D illustrate the operation by using a lifting mechanism of a first block.

DETAILED DESCRIPTION OF THE PREFERRED EMBODIMENT

Figure 1:
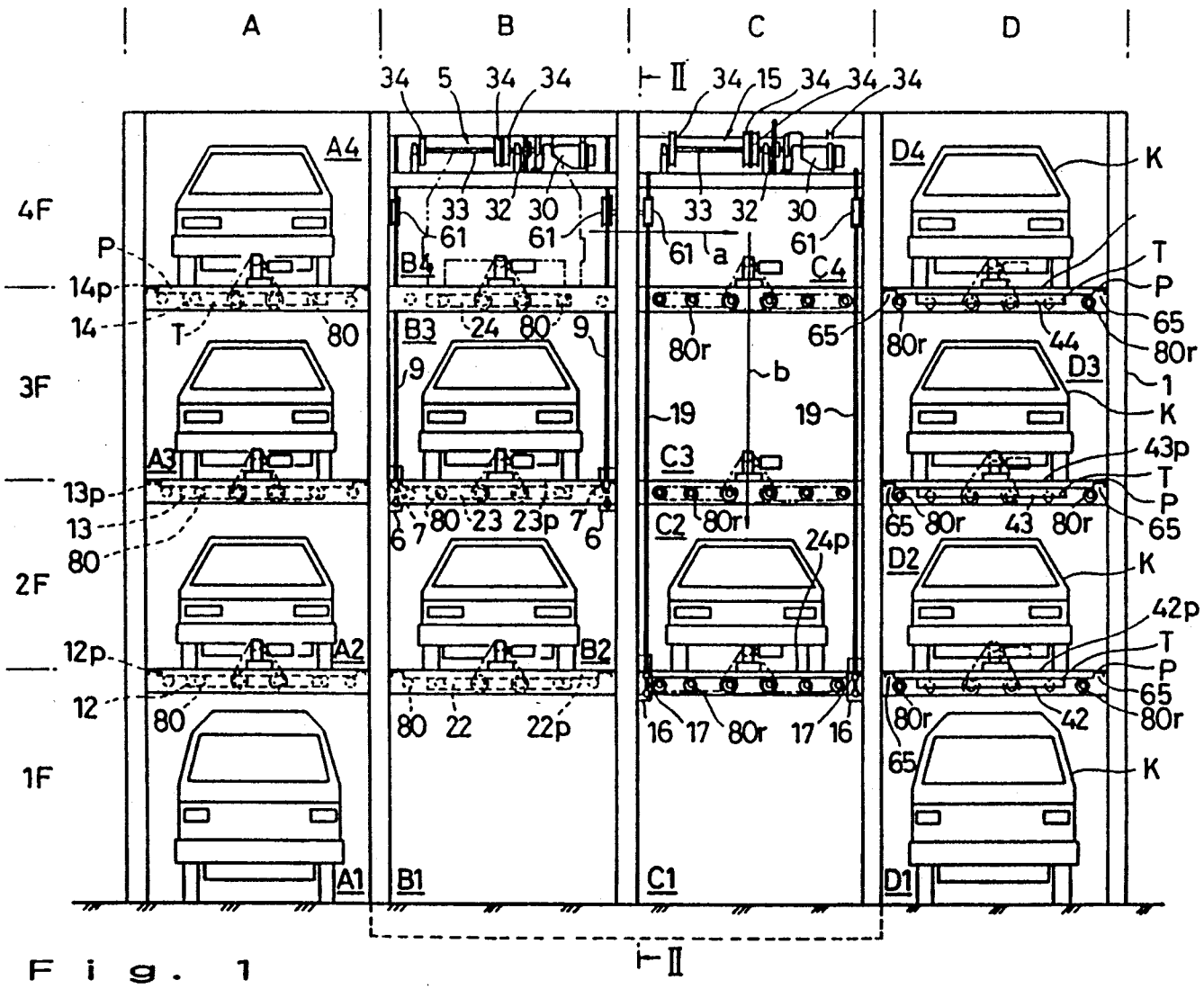
FIG. 1 is a front view of a multistory multicolumn storing installation of the present invention.
Figure 2:
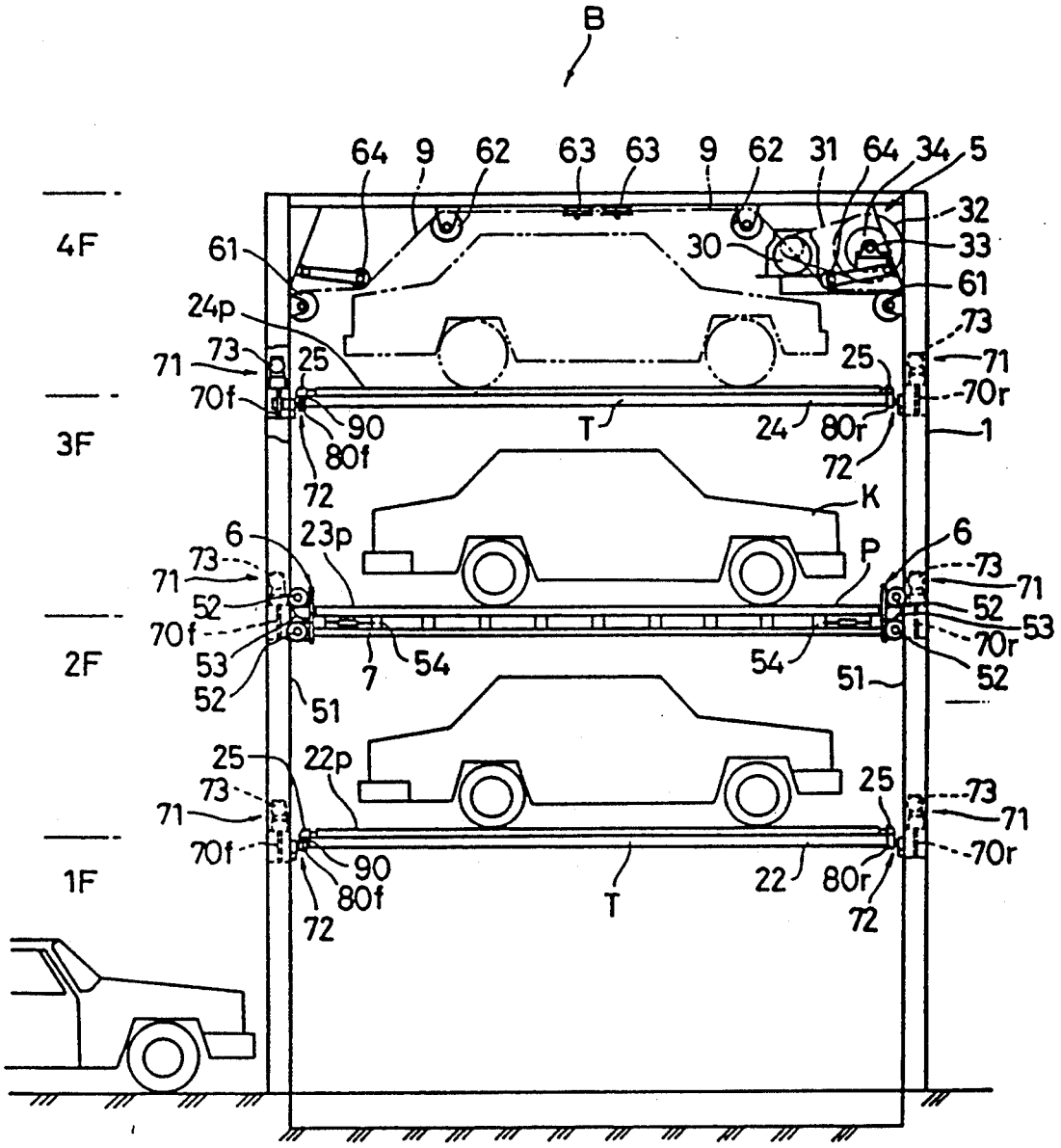
FIG. 2 is a sectional side elevation taken along the line II—II in FIG. 1.

Referring to FIGS. 1 and 2, a frame structure 1 is constructed to form storing columns A, B, C and D, and tiers 1F, 2F, 3F and 4F. As shown in FIG. 1, the left-hand storing columns A and B constitute a first block, and the right-hand storing columns C and D constitute a second block. Although there are no partition(s) between the adjacent storing columns, each storing division is designated by the names of the corresponding storing column and the corresponding floor; for example, the storing division on the third floor 3F in the storing column A is designated by "A3".

Vehicles are received or sent out from the first floor 1F. The storing columns A and D have storing divisions A1 to A4 and D1 to D4, exclusively for storing vehicles, with storing divisions A2 to A4 and D2 to D4. Namely, the second floor 2F up to the fourth floor 4F of columns A and D are provided with movable platforms indicated at 12, 13, 14, 42, 43 and 44, respectively, which are designated generally by T. Four lifting carriages 6 are disposed for vertical movement in the storing column B. The front and back lifting carriages 6, 6 on each side of the storing column B are connected by a lifting frame 7. A lifting mechanism 5 is disposed in the upper portion of the fourth floor 4F to suspend the lifting frames 7, 7 by wire ropes 9 to move the lifting frames 7, 7 vertically. Movable platforms indicated at 22, 23 and 24, which are designated generally by T, define storing divisions in the storing column B on the second floor 2F, the third floor 3F and the fourth floor 4F. The construction of the storing column C is similar to that of the storing column B. The storing column C is provided with front and back lifting carriages 16 on each side thereof, lifting frames 17 extended between the front and back lifting carriages 16, and a lifting mechanism 15 in the upper portion of the fourth floor 4F to suspend the lifting frames 17, 17 by wire ropes 19 to move the lifting frames 17, 17 vertically. The storing column C is not provided with any movable platform T.

Figure 3:
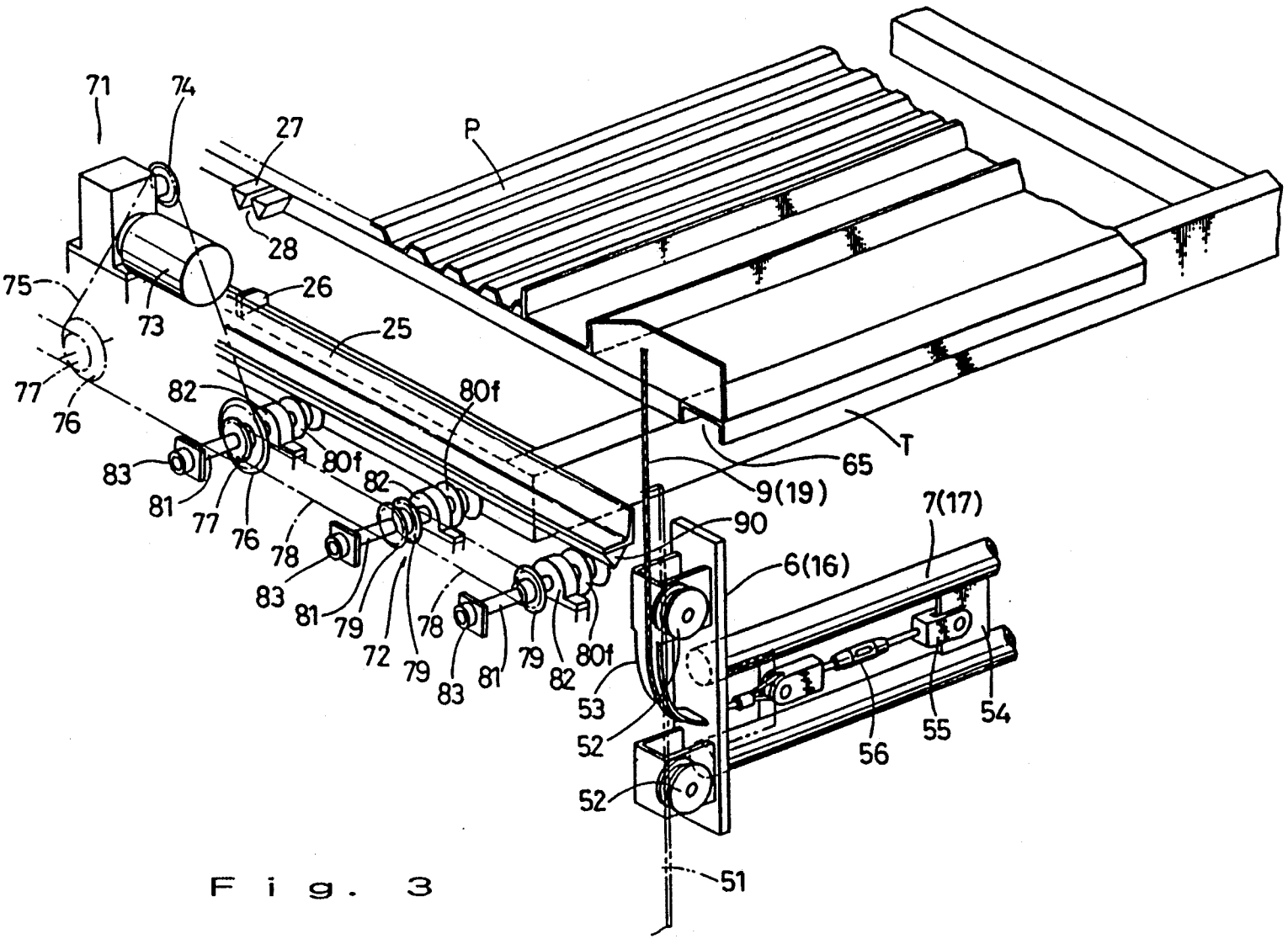
FIG. 3 is a perspective view showing the relationship between a movable platform, a driving unit, a transporting unit, a pallet and lifting frames of the multistory multicolumn storing installation of the present invention.

A pallet P to be loaded with a cargo, for example, a vehicle K, is placed on each movable platform T. Pallets P placed on the movable platforms 12, 13, 14, 22, 23, 24, 42, 43 and 44 are designated by 12*p*, 13*p*, 14*p*, 22*p*, 23*p*, 24*p*, 42*p*, 43*p* and 44*p*, respectively. All the movable platforms T are identical in shape and dimensions, and all the pallets P are identical in shape and dimension. Referring to FIG. 3, the front and back frame members 25 of the movable platform T are provided with projections 26, respectively, and the pallet P has its front and back edges with bifurcate projections 27, respectively. When the pallet P is put in place on the movable platform T, the projections 26 enter into and engage with grooves 28 of the corresponding bifurcate projections 27 to restrain the lateral displacement of the pallet P on the movable platform T. The front and back frame members 25 of the movable platform T restrain the pallet P from back-and-forth displacement.

The lifting mechanisms 5 and 15 are of identical construction and hence the corresponding parts thereof will be designated by the same reference numerals. The lifting mechanism 5 (15) is adapted to rotate the winding drums 34, 34, being directly connected with a shaft 33 of a sprocket 32 in the normal or the reverse direction through a chain 31 by means of a braked geared motor 30. As a result, wire ropes 9 (19) are wound around or drawn out from winding drums 34, 34. As shown in FIG. 3, the carriage 6 (16) is guided by rollers 52 on rails 51 provided on the frame structure 1. Each wire rope 9 (19) is extended along a guide plate 53 provided on the lifting carriage 6 (16), and the free end of the wire rope 9 (19) is connected to a stay 54 formed integrally with the lifting frame 7 (17) fixed to the lifting carriage 6 (16) by a connecting member 55. The tightness of the wire rope 9 (19) is adjusted by a turnbuckle 56. The other end of each wire rope 9 (19) is extended via guide pulleys 61, 62, 63 and a tension pulley 64 to the corresponding winding drum 34 and is fastened to the circumference of the winding drum 34. The braked geared motor 30 of the lifting mechanism 5 (15) thus constructed is controlled by a separately provided controller (not shown) to move the lifting frames 7 (17) upward or downward or to stop the lifting frames 7 (17) at a desired position.

The pair of lifting frames 7 (17) are moved vertically at the same speed in the storing column B (C) by the lifting mechanism 5 (15) provided in the storing column B (C). The span between the lifting frames 7 and 7 (17 and 17) is equal to the distance between the centers of downwardly opening channels 65 forming the opposite side edges of the pallet P. When the lifting frames 7 (17) are moved upwardly, they engage the channels 65 supported on the upper movable platform T and lift up the pallet P from the movable platform T.

A driving unit 71 for laterally moving the movable platform T and a transporting unit 72 are provided on each of a front beam 70*f* and a rear beam 70*r* of the frame structure 1 on each of the floors 2F, 3F and 4F of each of the storing columns A and B of the first block and the storing columns C and D of the second block. Each driving unit 71 has a braked geared motor 73 controlled by signals from a separately provided controller (not shown) for rotating a driving sprocket 74 in the normal or the reverse direction, or stopping its rotation. The driving sprocket 74 transmits the rotating motion to an intermediate sprocket 76 through a chain 75, and coupled sprockets 79 are all driven through chains 78, 78 by a driven sprocket 77 coaxial with the intermediate sprocket 76.

As shown in FIG. 3, the transporting unit 72 provided on the front beam 70*f* of the frame structure 1 has V-grooved rollers 80*f* arranged in a line. In FIG. 3, only one transporting unit 72 is shown as an example. The transporting unit 72 provided on the rear beam 70*r* has flat rollers 80*r*. As shown in FIG. 3, each of the sprockets 79 and each of the rollers 80*f* are fixedly mounted coaxially on a rotary shaft 81, so that the sprockets 79 and the rollers 80*f* rotate simultaneously in the same direction. Each rotary shaft 81 is supported in bearings 82 and 83 fixed to the front beam 70*f* of the frame structure 1. All the driving units 71 are identical in structure and all the transporting units 72 are identical in structure, and they are mounted on the front beams 70*f* and the rear beams 70*r* on all the floors of 2F to 4F of all the storing columns.

The rollers 80*f* supported on the front beam 70*f* and the rollers 80*r* supported on the rear beam 70*r* are rotated in the same direction at the same rotating speed to move the movable platform T supported on the rollers 80*f* and 80*r*. A rail 90 having a V-shaped cross section and attached to and projected from the lower surface of the frame member 25 of the movable platform T engages the V-grooved rollers 80*f* and movable platform T is moved laterally by the rotation of the rollers 80*f*, preventing back-and-forth displacement of the moving platform T. On the other hand, the flat lower surface of the frame member 25 of the movable platform T which is in contact with the flat rollers 80*r* assures smooth lateral movement of the movable platform T. Thus, the movable platform T is supported for lateral movement in a horizontal position on the rollers 80*f* supported on the front beam 70*f* of the frame structure 1 and on the rollers 80*r* supported on the rear beam 70*r* of the same.

Figure 4:
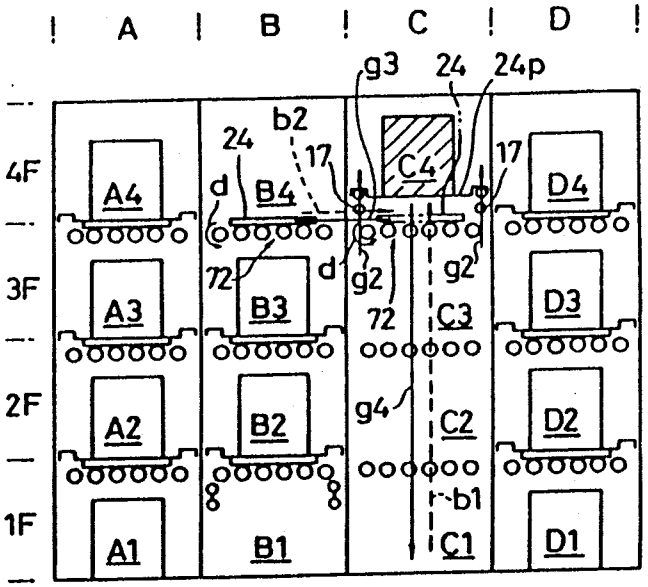
Figure 4:
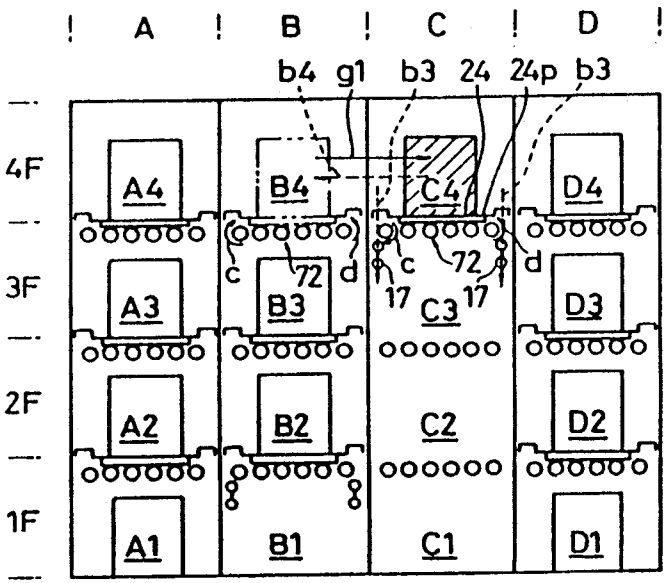
Figure 4:
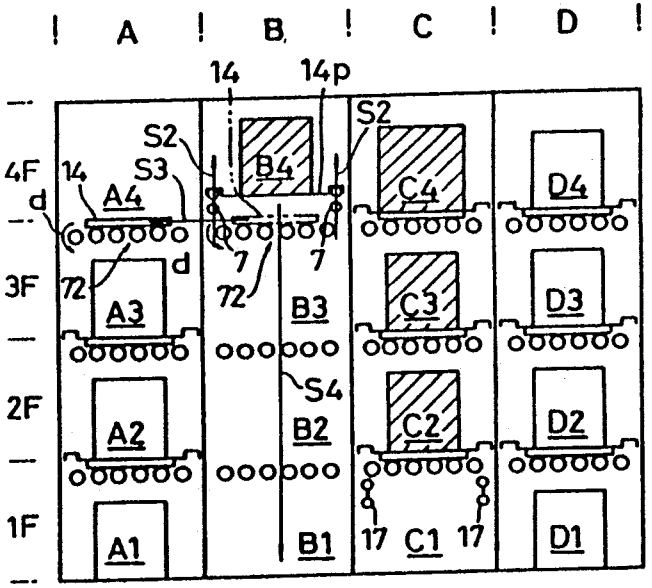
Figure 4:
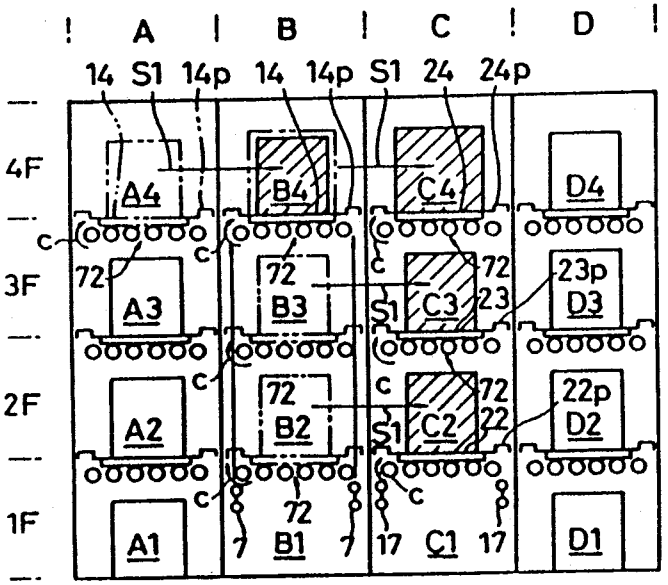

The operation of the multistory multicolumn storing installation of the present invention will be described by referring to FIG. 4, specifically to FIGS. 4A and 4B, with respect to transferring the cargoes (vehicles) in the directions of the arrows a and b as indicated in FIG. 1. Referring to FIG. 4A, the rollers 80*f* and 80*r* of the transporting units 72 of the storing divisions B4 and C4 are rotated simultaneously in the normal direction (an arrow mark c), thereupon the pallet 24*p* loaded with the cargo and stored in the storing division B4 is transferred, together with the movable platform 24, to the storing division C4 as indicated by an arrow mark g1. Then, in FIG. 4B, the lifting frames 17 are elevated as indicated by an arrow mark g2 to lift the pallet 24*p* alone from the movable platform 24 to a level where the pallet 24*p* does not interfere with the lateral movement of the movable platform 24. Then, the transporting units 72 of the storing divisions B4 and C4 are rotated simultaneously in the reverse direction (an arrow mark d) to return the movable platform 24 alone to the storing division B4 as indicated by an arrow g3. The lifting frames 17 of the column C are moved downwardly therethrough as indicated by an arrow g4 to the first floor 1F, since the space below the 4F in the column C is empty. Then, the cargo (vehicle) is sent out from the multistory multicolumn storing installation.

In storing a cargo (vehicle) in the storing division B4 or in returning the empty pallet 24*p* to the storing division B4, the foregoing procedure is reversed. Referring to FIG. 4B, the lifting frames 17 supporting the pallet 24*p* is moved upward through the storing column C as indicated by an arrow b1 to a level where the pallet 24*p* does not interfere with the lateral movement of the movable platform 24. Then, the transporting units 72 of the storing divisions B4 and C4 are rotated simultaneously in the normal direction (the arrow c) to move the movable platform 24 to directly under the pallet 24*p* supported on the lifting frames 17, whereupon the lifting frames 17 are lowered to place the pallet 24*p* on the movable platform 24. As shown in FIG. 4A, the lifting frames 17 are lowered further as indicated by an arrow b3 to a position where the lifting frames 17 may not interfere with the lateral movement of the movable platform 24. Subsequently, the transporting units 72 of the storing divisions B4 and C4 are rotated simultaneously in the reverse direction (the arrow d) to return the movable platform 24 mounted with the pallet 24*p* to the storing division B4 as indicated by an arrow b4.

FIGS. 4C and 4D illustrate the procedures of sending out the cargo (vehicle) stored in the storing division A4. Referring to FIG. 4C, all the transporting units 72 of the storing division A4 of the storing column A, the storing divisions B4, B3 and B2 of the storing column B, and the storing divisions C4, C3 and C2 of the storing column C are rotated in the normal direction (arrow c) to transfer the respective movable platforms 24, 23 and 22 of the storing divisions B4, B3 and B2, together with the pallets 24*p*, 23*p* and 22*p*, to the storing divisions C4, C3 and C2, respectively, and to transfer the movable platform 14 of the storing division A4, together with the pallet 14*p* loaded with the cargo, to the storing division B4 (an arrow s1).

Then, as shown in FIG. 4D, the lifting frames 7 are moved upwardly in the direction of an arrow s2 to lift the pallet 14*p* alone from the movable platform 14 to a position where the pallet 14*p* may not interfere with the lateral movement of the movable platform 14. The transporting units 72 of the storing divisions A4 and B4 are rotated simultaneously in the reverse direction (the arrow d) to return the movable platform 14 alone into the storing division A4 as indicated by an arrow s3. The lifting frames 7 are moved downwardly through the storing column B to the first floor 1F as indicated by an arrow s4 to send out the cargo (vehicle).

In storing a cargo (vehicle) in the storing division A4, the foregoing procedure is reversed. Thus, the description of procedure of storing the cargo in the storing division A4 is omitted. Procedures of storing cargoes in the rest of the storing divisions and procedures of sending out cargoes stored in the rest of the storing divisions will be surmised from the foregoing description, and hence the individual description thereof will be omitted. The lateral movement of the movable platforms T and the vertical movement and positioning of the lifting frames 7 and 17 are computer controlled with computer programs made for selecting the most rational moving passages.

Figure 5:
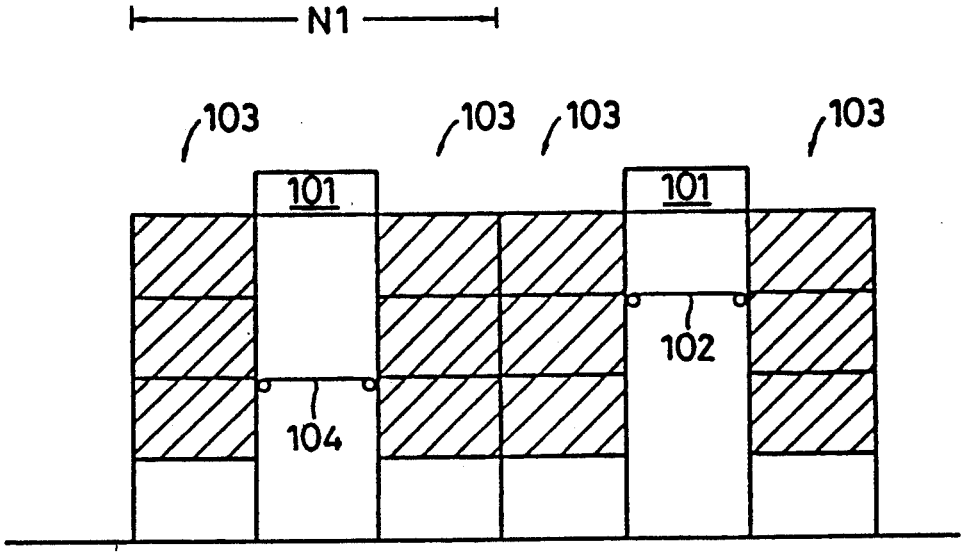
Fig. 5 (a) (PRIOR ART)
FIGS. 5A and 5B are diagrammatic views illustrating the difference in increasing the storing capacity between the multistory multicolumn storing installation of the present invention and a conventional tower type multistory storing installation.
Figure 5:
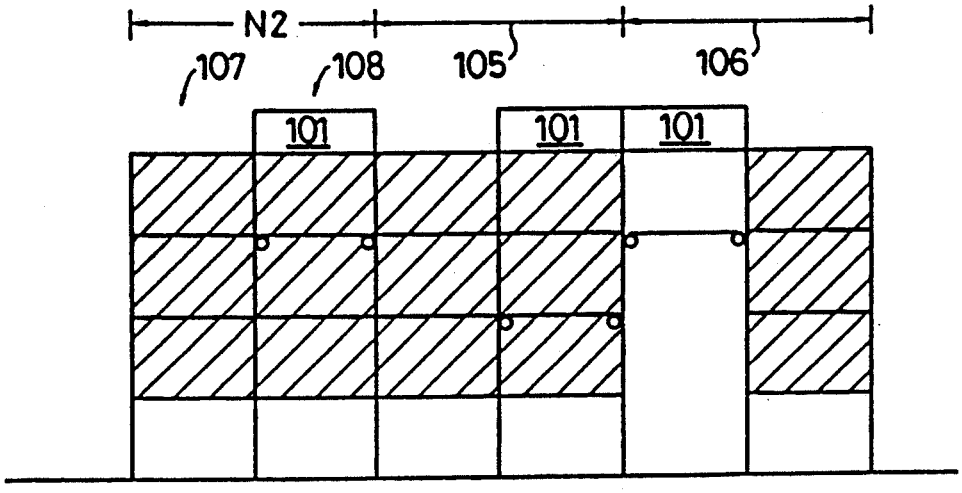

Referring to FIG. 5, in adding an additional block N1 of storing columns (shaded storing columns) to a conventional multistory storing installation of a tower type having storing columns 103 installed on both sides of a lifting platform 102 operated by a lifting unit 101 as shown in FIG. 5A, a new lifting platform 104 must be provided between the two additional storing columns 103. Therefore, a ground space corresponding to six storing columns is necessary for the four storing columns. On the other hand, in adding an additional block N2 having two storing columns 107 and 108 to the multistory multicolumn storing installation of the present invention having a first block 105 and a second block 106 as shown in FIG. 5B, the additional storing column 108 having a lifting mechanism 101 can be also used as a storing column. Therefore, with the present invention, the five storing columns can be installed in the same ground space as that needed by the four storing columns of the conventional multistory storing installation of a tower type, as shown in FIG. 5A.

The multistory multicolumn storage installation thus constructed in accordance with the present invention has the driving unit and the transporting unit for laterally moving the movable platform in each of the storing divisions of each of the columns of the first and second blocks. Therefore, one of the columns having the lifting mechanism can be utilized as an empty column for storing or sending out the cargo, and the other column also having the lifting mechanism can be utilized as the storing column, too. Thus, cargoes can systematically be stored and transferred, and both lifting mechanisms of the two columns can be used simultaneously for the efficient reception and delivery of cargoes. Cargoes can be received on or delivered from any of the floors. Furthermore, an additional block comprising two columns, one of which is provided with the lifting mechanism and having the movable platform in all of the storing divisions, except the storing division which is utilized for initially receiving and finally sending out the cargo, may be added to increase the storing capacity. Such additional block or blocks can be added in any desired number.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A storage assembly comprising:

a structure defining a plurality of storage spaces, said structure configured to have first, second, and third columns wherein said second column is adjacent said first column, said third column is adjacent said second column, said columns are arranged to have a base level and at least two storage levels that are vertically spaced from said base level, and said storage spaces are located on said storage levels of said first and second columns;

a plurality of pallets disposed in said structure for holding articles to be held in said storage spaces, each said pallet being constructed to hold articles in an individual one of said storage spaces;

a horizontal transport mechanism for laterally moving said pallets between said columns, wherein said horizontal transport mechanism is capable of simultaneously moving all of said pallets located in one column to an adjacent column, thereby clearing a column of pallets so that it may be used to vertically move pallets;

a first lift mechanism attached to said structure for vertically moving a pallet positioned in said third column between said base level and a position adjacent a storage space in said second column; and a second lift mechanism attached to said structure for moving a pallet through said second column between said base level and a position adjacent said storage spaces in said first and third columns.

2. The storage assembly of claim 1 wherein:

said structure is formed to have a fourth column located adjacent said third column, said fourth column having at least two storage levels that define storage spaces capable of receiving said pallets;

said first lift mechanism is further capable of moving a pallet positioned in said third column between said base level and a position adjacent a storage space in said fourth column; and said horizontal transport mechanism is capable of moving said pallets between said third column and said storage spaces of said fourth column.

3. The storage assembly of claim 2, wherein said horizontal transport mechanism includes a plurality of movable platforms for transferring said pallets between said columns.

4. The storage assembly of claim 2, wherein:

said structure includes a fifth column located adjacent said first column and a sixth column located adjacent said fifth column, said fifth and sixth columns defining a set of storage spaces located adjacent said storage spaces defined by said first column for receiving said pallets;

said horizontal transport mechanism is further capable of moving said pallets between said fifth column and said first column and between said sixth column and said said fifth column; and a third lift mechanism is attached to said structure for moving said pallets through said fifth column between said structure base level and a level adjacent said storage spaces of said first and sixth columns.

5. The storage assembly of claim 4, wherein said horizontal transport mechanism includes a plurality of movable platforms for transferring said pallets between said columns.

6. The storage assembly of claim 1, wherein said structure base level is located below said storage levels.

7. The storage assembly of claim 4, wherein said structure base level is located below said storage levels.

8. A garage for storing vehicles, the garage including:

a structure defining a plurality of storage spaces, said structure configured to have four columns wherein a second column is adjacent a first column, a third column is adjacent said second column, a fourth column is adjacent said third column, said columns are arranged to have a base level and at least two storage levels that are horizontally spaced from said base level, and said storage spaces are located on said storage levels of said first, second, and fourth columns;

a plurality of pallets disposed in said structure for holding vehicles in said storage spaces, each said pallet being positioned to hold a vehicle in a separate one of said storage spaces;

a horizontal transport mechanism for laterally moving said pallets between said columns, wherein said horizontal transport mechanism is capable of simultaneously moving all said pallets located in one column to an adjacent column, thereby clearing a column of pallets so that it may be used to vertically move pallets;

a first lift mechanism attached to said structure for vertically moving a pallet positioned in said third column between said structure base level and a position adjacent said second and fourth column storage spaces; and a second lift mechanism attached to said structure for vertically moving a pallet positioned in said second column between said structure base level and a position adjacent said first and third column storage spaces.

9. The garage of claim 8, wherein said horizontal transport mechanism includes a plurality of movable platforms for transferring said pallets between said columns.

10. The garage of claim 8, wherein said structure base level is located below said storage levels.

11. The garage of claim 9, wherein said structure base level is located below said storage levels.

12. A storage assembly capable of storing a multiple number of articles, the assembly comprising:

a structure defining a plurality of storage spaces, said structure configured to have at least four vertically oriented columns, each said column having a base level, and at least two storage levels separate from said base level;

a plurality of movable pallets disposed in said structure for holding articles in said storage spaces, said pallets being positioned in said structure so that at least one storage column is normally free of said pallets;

a horizontal transport mechanism for laterally moving said pallets between said columns, including into and out of said column normally free of said pallets, said horizontal transport mechanism capable of simultaneously moving all of the pallets in one column to an adjacent column, thereby clearing a column of pallets so that it may be used to vertically move pallets; and a plurality of lift mechanisms attached to said structures for moving said pallets through different said columns between said structure base level and said structure storage levels, two said lift mechanisms being positioned to move said pallets through two different said columns, one of said lift mechanism is positioned to move said pallets through a column adjacent said column that is normally free of said pallets, and said lift mechanisms being positioned so that each said pallet is a maximum of a single column away from one of said lift mechanisms.

13. The storage assembly of claim 12, wherein said structure is formed to have at least six said columns with storage spaces in which said pallets can be located and at least three lift mechanisms, wherein said lift mechanism are spaced from each other so that each said pallet is only a single column away from one of said lift mechanisms.

14. The storage assembly of claim 12, wherein said structure base level is located below said storage levels.

15. The storage assembly of claim 12 wherein at least two said lift mechanisms are positioned to move said pallets through adjacent said columns.

16. The storage assembly of claim 15 wherein one of said two adjacent lift mechanisms is positioned to move said pallets through said column that is normally free of said pallets.

17. The storage assembly of claim 16, wherein said structure base level is located below said storage levels.

* * * * *